United States Patent [19]

Guerrera

[11] Patent Number: 4,934,637

[45] Date of Patent: Jun. 19, 1990

[54] BAG HOLDING BRACKET DEVICE

[76] Inventor: Joseph Guerrera, 943 E. 29th St., Brooklyn, N.Y. 11210

[21] Appl. No.: 342,171

[22] Filed: Apr. 24, 1989

Related U.S. Application Data

[63] Continuation-in-part of Ser. No. 225,968, Jul. 29, 1988, abandoned.

[51] Int. Cl.[5] ..... B65B 67/04

[52] U.S. Cl. ..... 248/100; 248/101; 248/307

[58] Field of Search ..... 248/100, 101, 99, 97, 248/95, 295.1, 307, 290, 322, 327, 339; 220/404, 1 T

[56] References Cited

U.S. PATENT DOCUMENTS

| | | | |
|---|---|---|---|
| 199,507 | 1/1878 | Brubaker | 248/100 |
| 840,316 | 1/1907 | Gregory | 248/100 |
| 1,145,297 | 7/1915 | Erickson et al. | 248/100 X |
| 2,113,153 | 4/1938 | Jonassen | 248/101 |
| 2,423,325 | 7/1947 | Jones | 248/100 |
| 2,451,829 | 10/1948 | Hightower | 248/100 |
| 3,130,853 | 4/1964 | Colthurst et al. | 248/100 X |
| 4,728,070 | 3/1988 | Engelbrecht | 248/100 X |
| 4,735,340 | 4/1988 | Preston | 248/100 X |
| 4,762,297 | 8/1988 | Milligan | 248/100 X |
| 4,763,808 | 8/1988 | Guhl et al. | 248/100 X |

*Primary Examiner*—Ramon O. Ramirez
*Attorney, Agent, or Firm*—Edwin D. Schindler

[57] ABSTRACT

A trash bag holding bracket device which has a frame, which is preferably of a rectangular shape and which, preferably, includes means for the adjustability of the shape of such frame is disclosed. Attachment, in either a removable or fixed manner, is achieved by a plurality of clips, preferably located at points along the frame wherein such clips can adequately support the frame of the invention within the dimensions of the trash basket being used. The plurality of clips are to engage the upper rim of the trash basket in a manner wherein the clips surround the upper rim of the basket. Preferably, the clips are also shaped in a manner in which their shape reinforces the securement of the clips to the top portion of the basket.

19 Claims, 1 Drawing Sheet

BAG HOLDING BRACKET DEVICE

This application is a continuation-in-part of application Ser. No. 07/225,968, filed, July 29, 1988 now abandoned.

BACKGROUND OF THE INVENTION

1. Technical Field of Invention

The present invention relates, generally, to a bag holding bracket device. More particularly, the present invention relates to a bag holding bracket device for use within a trash basket, or similar container, wherein a bracket, preferably of an adjustable length and width, is secured along the upper portion of the trash basket. The bracket of the invention is provided with a plurality of clips which, preferably, act to both secure the holding device of the invention to the trash basket and act to secure the trash bag, within the trash basket, in a manner which permits the trash bag to remain open for the convenient placement of refuse therein.

2. Description of the Prior Art

Heretofore, standard trash baskets, available on the market. are primarily designed so that the trash bags to be used in combination with the trash baskets, preferably flexible plastic trash bags, have to be inconveniently inserted into the trash basket with a provision being made by the user to have a portion of the top of the trash bag outwardly inverted in order to rest over the top portion of the trash basket. This "flap-over" feature is unattractive and significantly reduces the volume of the trash bag for holding trash.

All homes utilize waste baskets. Supermarkets, meat markets, fruit markets and many other general stores funish plastic bags to the consumer for the purpose of carrying their purchases home. Such plastic bags, to the consumer, have become extremely popular of late. These bags accumulate in the home so, instead of discarding them, such bags can be utilized for garbage disposal. This would not only reduce litter, but would save consumers money as well. The present invention includes hooks wherein the handle portion of such bags can be secured to hooks.

The prior art generally includes trash containers having rather complex, integral and unattractive means for attempting to secure, in some fashion, a trash bag to a trash basket. Such devices are disclosed in U.S. Pat. Nos. 2,423,325; 3,130,853; and, 4,576,810. Such prior art devices also do not permit the flexibility afforded by a device which includes means for adjusting, in size and shape, a holding bracket to numerous types of trash baskets for more versatile use.

SUMMARY OF THE INVENTION

Accordingly, it is an object of the present invention to provide a trash bag holding bracket device which eliminates the requirement of having a user create a flap-over in order to secure the trash bag to the trash basket.

It is a further object of the present invention to provide a trash bag holding bracket device which may be conveniently secured and removed from numerous trash baskets of different sizes and shapes by virtue of having an adjustable size and shape.

It is still a further object of the present invention to provide a user with a means for utilizing plastic shopping bags, in an economical and convenient manner, in refuse collection and removal.

It is still a further object of the present invention to provide a trash bag holding device which is both simple and economical to manufacture.

It is yet a further object of the present invention to provide a clip for use in combination with a trash basket for securing a trash bag within the trash basket.

It is an additional object of the present invention to provide a trash bag holding device which overcomes the disadvantages of the prior art.

The foregoing and related objects are achieved by a trash bag holding bracket device which has a frame, which is preferably of a rectangular shape and which, preferably, includes means for the adjustability of the shape of such frame. Attachment, in either a removable or fixed manner, is achieved by a plurality of clips, preferably located at points along the frame wherein such clips can adequately support the frame of the invention within the dimensions of the trash basket being used. The plurality of clips are to engage the upper rim of the trash basket in a manner wherein the clips surround the upper rim of the basket. Preferably, the clips are also shaped in a manner in which their shape reinforces the securement of the clips to the top portion of the basket. There are preferably four clips which are conveniently secured at corners of the device of the present invention. It should, of course, be recognized that the device of the present invention may be designed for circular trash containers or other unusually shaped containers. For a circular trash basket, for example, the use of three clips would likely be sufficient to secure the frame of the device of the invention to the upper portion of the basket.

The frame of the bag holding device of the present invention also includes a plurality of hooks, which would be contained within the trash basket, when the device of the present invention is secured in place. These hooks would secure the trash bag within the basket. The trash bag might preferably contain preformed holes for securement to the hooks of the frame of the invention, through such holes are not necessary and the hooks of the invention should be designed to firmly secure any standard trash bag, such as plastic trash bags, which are highly flexible and versatile. For rectangular trash bag, preferably four hooks, located at the corners of the frame of the invention are preferred. Other arrangements are, of course, possible, and are contained within the scope of the present invention.

In addition, it should also be recognized that the clips and hooks of the present invention may be integrally formed and, in the manufacturing process of the present invention, may be formed as one piece for securement to the frame of the present invention.

Finally, the present invention includes a separate clip article for use in combination with trash basket and basket bag, wherein the holding clip and the hook are designed as an integral article and ma be directly clipped to the upper rim of a trash basket without tbe frame of the present invention. A plurality of such clips can be employed by the user to hold a trash bag within a trash basket.

Other objects and features of the present invention will become apparent when considered in conjunction with the accompanying drawing figures. It should, of course, be recognized that the accompanying drawings illustrate a preferred embodiment of the present invention and are not designed as a means for defining the limitations and scope thereof.

BRIEF DESCRIPTION OF THE DRAWING

In the drawing figures, wherein similar references numerals denote similar features throughout the several views:

FIGS. 3A and 4B show a side view of the adjustability clip of FIG. 2;

DETAILED DESORIPTION OF THE DRAWING

Figure 1:
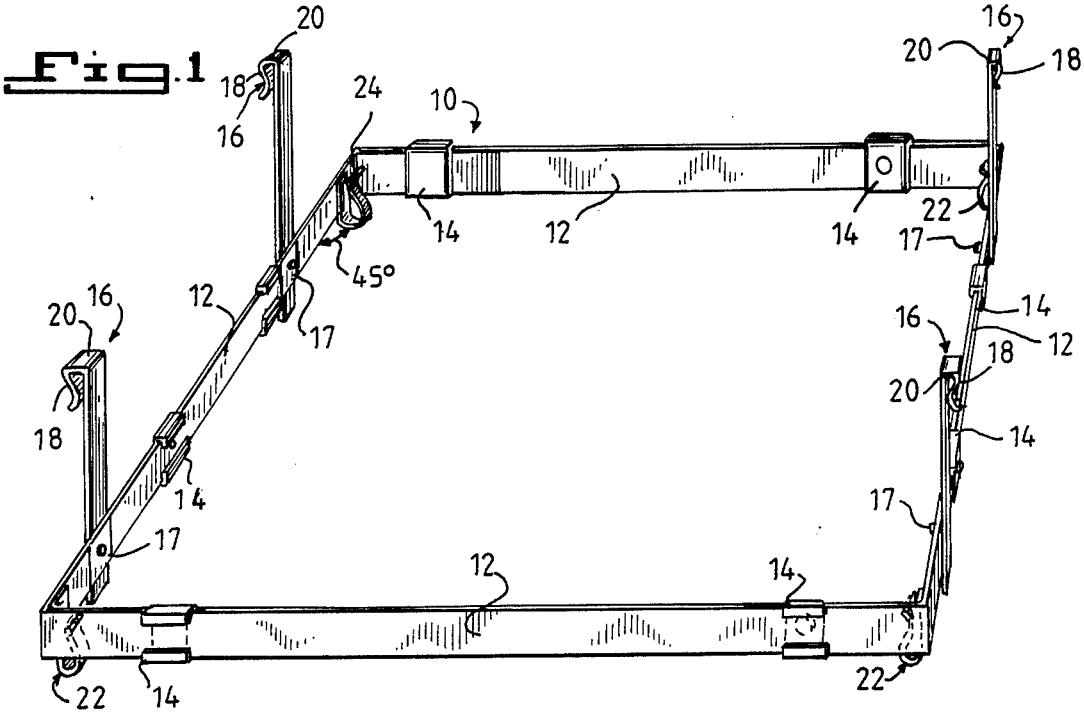
FIG. 1 is a perspective of the bag holding bracket device of the present invention wherein the size of the frame of the device is adjustable.

Turning now, in detail, to the drawing, FIG. 1 is a prospective view of the bracket holding device 1O of the present invention. Device 10 is shown as being rectangular though it will be understood that other sizes and shapes are possible. Device iO includes frame 12 which includes adjustability means 14 for permitting an adjustment of one or more sides of frame 12. Attached in either a removable or affixed fashion are clips 16 for securing device 10 over the upper rim of a trash basket The device shown includes four clips, however, a fewer or greater number of clips may be utilized, as appropriate, depending upon the size and shape of the device and trash basket. Clips 16, preferably, includes top securement portions which include a resilient indentation whereby the curved indentation may firmly rest along the outer side of the upper portion of a trash basket, preferably, just below the rim of a trash basket. Clips 16 are, preferably, adjustable vertically, relative to frame 12 by adjustment means 17. Such means for the vertical adjustment of clips 16 relative to frame 12 may include, for example, a screw which may be loosened during the adjustment procedure and, thereafter, again tightened in order to secure clips 16 in place relative to frame 12. The benefit of such a feature is that it permits the bag holder of the present invention to be placed in locales, such as beneath a kitchen sink, where the surrounding free or open space may be limited. Clips 16, as with the entire device 10 of the present invention is preferably made of a durable flexible plastic or metal, though the manufacture of device 10, from other materials, is also possible. The upper rim of a trash basket would rest against the inner side of portion 20 of clip. 16. Indentation 18 would be, substantially, on the outer side of the trash basket. The remainder of the device would be retained within the dimensions of the trash basket Finally, frame 12 also includes hooks 22 for securing of trash bags within a trash basket. Hooks 22 would be fully within the dimensions of the basket and not readily seen from outside the basket. As illustrated in the preferred embodiment of FIG. 1, there are preferably four hooks (22) secured at the corners of frame 12 in a manner in which hooks 22 are directed substantially to the center of the basket. Hooks 22 are preferably at approximately 45° angles with the two nearest sides of frame 12 to each particular hook. This preferred construction, permits a trash bag being utilized in connection with the present invention, to fully rest against the walls of the trash basket, including allowing the trash bag to be held in a fully open position against the corners of the basket, rather than, as is known to be the case with numerous prior art devices. holding the trash bag in a position wherein the upper edge of the trash bag does not rest, or fit into, the corners of the basket in which it is so held.

Hooks 22 also preferably include an indentation 24 whereby this indentation is resilient and is capable of firmly securing the trash bag being secured against the inner side of a trash basket. This indentation (24) should be seen as being somewhat analogous to indentation 18. Hooks 22 are, therefore, preferably made of a firm and durable material which, nevertheless, contains some measure of resiliency.

Figure 2:
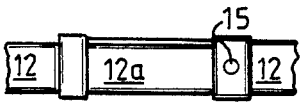
FIG. 2 is an elevational view of a broken away portion of the preferred adjustability means of the frame of the device in FIG. 1.

FIG. 2 shows, in detail, a section of frame 12 and a preferred means for adjusting the length of a side of frame 12. It should be understood that all sides of frame 12 may be, likewise, so adjusted. More particularly, frame 12, as shown in FIG. 2, actually comprises two segments, **12*a* and 12*b*. These segments are intended to overlap to some extent. The overlap between segments 12*a* and 12*b*, of frame 12, are capable of being tightly secured by fasteners 14**

Figure 3A:
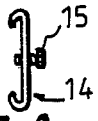
Figure 3B:
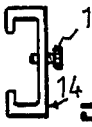
Figure 4:
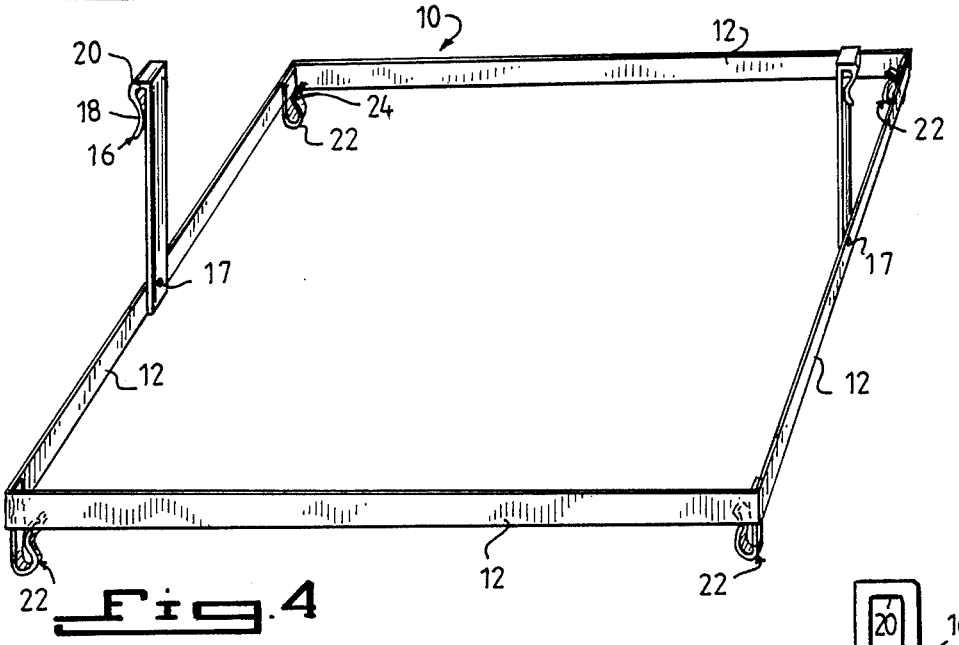
FIG. 4 is a perspective view of the bag holding bracket device of the present invention without means for adjusting the size of the frame of the invention; and, FIG. 5 is an elevational view of a clip-and-hook article for use without the frame of the device of the present invention for securing a trash bag with a trash basket.

Two types of fasteners 14 are shown in FIGS. 3A and 3B. Such fasteners, at least partially, encircle overlapping portions of segments **12*a* and 12*b*. In a preferred embodiment of the present invention, a screw 15 is provided through fasteners 14. When segments 12*a*, 12*b* overlap, and the overlap is desired to be secured, fasteners 14 (preferably two such fasteners, though fewer fasteners or a greater number of fasteners are possible) would at least partially encircle segments 12*a*, 12*b* of frame 12 and screw 15, in position in fasteners 14, as shown in FIGS. 3A and 3B, would be turned to tighten the overlap in a vice-like arrangement. To again adjust the length of a side of frame 12, the screw would be loosened, the overlap of segments 12*a* and 12*b* would be adjusted, and the screws 15 would again be tightened. It should, of course, be realized that other adjustment means are possible. It should, of course, also be recognized that the holder of the present invention (!0), may be constructed without an adjustability feature, as shown in FIG. 4**.

Figure 5:
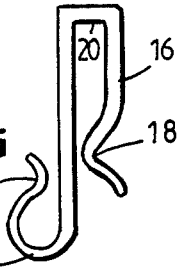

Finally, FIG. 5 shows a an integral clip-and-hook device, analogous to the clips 16 and hooks 22 shown in the device of FIGS. I and 4. The integral clip-and-hook device of FIG 5 can be used either in combination with a frame 12 or may be utilized without a frame. In the latter case, a plurality of the clip-and-hook device of FIG. 5 would be securely to the upper rim of a trash basket. Clip portion 16, with resilient indentation 18, would be secured along the outer side of the trash basket, while hook 22, which would hold a trash bag within the trash basket, would be secured with resilient indentation 24 within the dimensions of the basket.

It will, of course, be recognized that the use of indentations 18 and 24 is an optional, yet preferred feature of the invention.

In an additional embodiment of the present invention, it is possible, and often desirable, to produce the present invention wherein if the trash basket is made of metal, a manufacturer can spot weld hooks within the trash basket for securing a trash bag. All means for making such hooks, within the trash basket integral with the basket, are encompassed within the scope of the present invention.

If the trash basket is made of plastic, or any suitable material which requires a mold, then the trash basket may have hooks cast within the basket in an integral fashion.

While several embodiments of the presen invention have been shown and described, it will be obvious to those of ordinary skill in the art that many modifications may be made to the present invention Without departing from the spirit and scope thereof.

What is claimed is:

1. Apparatus for securing a bag within a basket, comprising:

a frame;

a plurality of clips attached to said frame for securing the frame to an upper portion of the basket, said plurality of clips being vertically adjustable relative to said frame; and, a plurality of hooks attached to said frame for securing the bag within the basket.

2. Apparatus according to claim 1, wherein said frame includes means for the adjustment of the size of said frame.

3. Apparatus according to claim 2, wherein said means for adjustment of said frame include at least one fastener for securing an overlap of two segments of said frame.

4. Apparatus according to claim 3, wherein said fastening is secured by means of a screw.

5. Apparatus according to claim 1, wherein said frame has a rectangular shape.

6. Apparatus according to claim 1, wherein said frame has a non-rectangular shape.

7. Apparatus according to claim 1, wherein said frame is made of metal.

8. Apparatus according to claim 1, wherein said frame is made of a plastic.

9. Apparatus according to claim 1, wherein said frame is made of a resilient material.

10. Apparatus according to claim 1, wherein said plurality of clips is four.

11. Apparatus according to claim 1, wherein at least some of said clips of said plurality of clips include a resilient curved-shaped indentation for securing said clips of said frame against an outer side of the basket.

12. Apparatus according to claim 1, wherein said plurality of clips is made of a resilient material.

13. Apparatus according to claim 1, wherein said plurality of hooks is four.

14. Apparatus according to claim 1, wherein at least some of said hooks of said plurality of hooks include a resilient curved-shaped indentation for securing said hooks of said frame against an 1nner side of the basket in order to more securely hold the bag within the basket.

15. Apparatus according to claim 1, wherein said plurality of hooks is made of a resilient material.

16. Apparatus for securing a bag within a basket, comprising:

a frame made up of a plurality of sides;

a plurality of clips attached to said frame for securing the frame to an upper portion of the basket, said plurality of clips being vertically adjustable relative to said frame; and, a plurality of hooks attached to said frame for securing the bag within the basket, each of said hooks of said plurality of hooks being positioned within the dimensions of the basket, at a corner of said frame at substantially a 45°-angle to the sides of said frame and directed substantially toward the center of the basket, the corner of said frame being formed by an intersection of two of the sides of said frame.

17. Apparatus according to claim 16, wherein said frame includes means for the adjustment of the size of said frame.

18. Apparatus according to claim 16, Wherein at least some of said clips of said plurality of clips include a resilient curved-shaped indentation for securing said clips of said frame against an outer side of the basket.

19. Apparatus according to claim 16, wherein at least some of said hooks of said plurality of hooks include a resilient curved-shaped indentation for securing said hooks of said frame against an inner side of the basket in order to more securely hold the bag within the basket.

* * * * *